US005150817A

United States Patent [19]

Livingston

[11] Patent Number: 5,150,817

[45] Date of Patent: Sep. 29, 1992

[54] METHODS AND APPARATUS FOR DISPENSING ARTICLES

[75] Inventor: Troy W. Livingston, Northbrook, Ill.

[73] Assignee: Inn-Room Systems, Inc., Sudbury, Mass.

[21] Appl. No.: 539,003

[22] Filed: Jun. 15, 1990

[51] Int. Cl.[5] ..... G07F 11/00

[52] U.S. Cl. ..... 221/81; 221/88; 221/253

[58] Field of Search ..... 221/79, 80, 81, 76, 221/87, 88, 263, 264, 253, 266

[56] References Cited

U.S. PATENT DOCUMENTS

| | | | |
|---|---|---|---|
| 1,415,337 | 5/1922 | Grover | 221/81 |
| 1,460,574 | 7/1923 | Coseglia | 312/36 |
| 2,058,727 | 10/1936 | Schreiber | 125/23 |
| 2,156,196 | 4/1939 | Romanoski | 312/48 |
| 2,215,642 | 9/1940 | Gabrielsen | 312/48 |
| 2,252,493 | 8/1941 | Dennis | 312/48 |
| 2,253,447 | 8/1941 | Stanford | 312/87 |
| 2,282,269 | 5/1942 | Tone | 194/10 |
| 2,285,931 | 6/1942 | Kruckewitt et al. | 312/45 |
| 2,296,154 | 9/1942 | Elliott, Sr. | 312/36 |
| 2,309,008 | 1/1943 | Pease | 312/96 |
| 2,439,475 | 4/1948 | Kruse | 312/48 |
| 2,837,237 | 6/1958 | Stewart | 221/11 |
| 2,889,074 | 6/1959 | Reynolds | 221/108 |
| 4,000,800 | 1/1977 | Loucks, Sr. | 194/9 R |
| 4,192,436 | 3/1980 | Schuller et al. | 221/129 |
| 4,515,290 | 5/1985 | Fishler | 221/124 |
| 4,629,090 | 12/1986 | Harris et al. | 221/7 |
| 4,687,119 | 8/1987 | Juillet | 221/101 |

FOREIGN PATENT DOCUMENTS 2101982 1/1983 United Kingdom .

*Primary Examiner*—D. Glenn Dayoan
*Assistant Examiner*—Kenneth Noland
*Attorney, Agent, or Firm*—Fitch, Even, Tabin & Flannery

[57] ABSTRACT

A vending apparatus for use in a hotel to vend a plurality of articles comprises a housing having vertical, substantially cylindrical access doors providing access in each of a plurality of vending units to a vended article. The vendee will actuate a handle for the vending unit to turn an access door for that unit from a closed position denying access to the article to a vending position to allow removal of the vended article. The preferred system is cashless and a control device in the form of push buttons is operated to cause the vending operation of the selected vending unit; and a signal is sent to a computer to record the transaction and/or add the price of the vended article to the guest's hotel bill. After recordation, an electrical signal is sent to the vending unit to enable the manual actuation of the vertical, substantially cylindrical access door selected. The vended articles are carried into position for vending on a horizontal endless conveyor belt behind each access door upon return of the unit's handle and its access door to the closed position.

18 Claims, 7 Drawing Sheets

METHODS AND APPARATUS FOR DISPENSING ARTICLES

This invention relates to a dispensing or vending apparatus generally and is particularly directed to hotel room vending apparatus for vending refrigerated articles such as beverages and snacks.

The current most widely used systems of hotel vending include an honor bar type of system in which bottles of liquor, wine, beer, soft drinks as well as snack foods are kept in an open refrigerator in a hotel room. The typical refrigerators are about four feet in height or less. The hotel guest has immediate access to all of the inventory. If the guest leaves his room unattended, someone may steal the contents of the refrigerator. Guests sometimes use the expensive beverages and replace them with inexpensive beverages and this transaction is not easily caught or corrected. In order to inventory what the guest has used, a person must go the the room and count what is missing and then restore the inventory to its full count for the next guest. In hotels having hundreds of rooms, the labor involved is high. Theft or loss in such honor bar systems may be as much as thirty percent in some instances.

Another conventional hotel room bar vending system is disclosed in U.S. Pat. No. 4,629,090 in which a plurality of dispensing magazines are provided inside a refrigerated housing or cabinet. Each magazine has an access door which is locked and can be opened upon unlocking by a control system which includes a local microprocessor in the refrigerated cabinet connected over the hotel TV cables to a central monitoring processor for all of the hotel rooms. Opening of the access door breaks a beam of light from an optical fiber and lens system associated with each magazine. Within the magazine a plurality of bottles are laid on their sides on a downwardly inclined bottom wall to roll down by gravity to a position in front of the access door. Many articles to be dispensed are not round and will not roll easily. With the bottles on their sides, the labels on the bottles are difficult to read unless one turns on one's side. The labels may roll underneath the bottle so they can not be seen. The jiggling of a bottle or the access door may cause a false breaking of the optical beam and generate false signals which are sent to the monitoring computer to charge the guest for a plurality of articles when only one article has been vended. The cost of the optical fibers and sensors for each magazine is also important. Often, the refrigerated bar may have ten to fifteen magazines and a hotel may have hundreds of rooms. Thus, the cost of each magazine and of each refrigerated bar is an important commercial consideration in the total cost to the hotel supplying such refrigerated bars to its guests.

Other patents directed to this rolling container dispenser with optical fiber detection are U.K. patents 2,101,982; 2,161,630; and 2,135,292. Other prior art is disclosed in U.S. Pat. Nos. 3,749,279; 3,979,017; and 3,556,343.

The present invention is directed to providing a low cost and high security system for dispensing or vending articles particularly in a cashless manner, in which a credit card or automatic monitoring and crediting system is employed. In a hotel room setting, the monitoring and release of an article to be dispensed and the amount to be charged for the vended article is done by a central monitor processor as disclosed in pending patent application of Martin J. Durbin entitled "Interactive Network For Remotely Controlled Hotel Vending Systems" filed Jun. 15, 1990 and assigned to the assignee of this application; this application being incorporated by reference as if fully reproduced herein.

The present invention is directed to providing as many as sixteen magazines or vending units in each refrigerated bar of about 3½ cubic feet in volume with the magazines being capable of each holding about five beverages or other articles providing a total of eight five vendable articles. Some of the compartments may not be refrigerated as they may hold candy, potato chips, pretzels or other materials that are typically not refrigerated.

Hotel rooms vending equipment is accessible to people who may have plenty of time and incentive to try to break the security of the system to get free products. In the past, where there is a direct manual actuator such as a pull handle, people tended to jiggle the operator or to return the handle slowly and listen for a catch or dog to click and before the lock is caught to again, to pull the handle to try to get a free vend. People may try to poke holes in beverages cans and to sip the contents out through a straw if they have direct access to more than the vended beverage can.

Another problem with people in hotel vending operations is the amount of force or speed of operation of the vending unit. If the articles are on conveyors that are directly driven by the force being applied by the person pulling on the handle, the force may be very high causing an extreme acceleration of the conveyor. If the cans or bottles or upright as in the present invention, such accelerations or decelerations may tip over the can or bottle. The present invention also has anti-tipping means of a very low cost design to assist in holding the bottles or cans upright in case someone tries to move or shake the refrigerated bar.

The present invention provides a very low cost drive for conveyor belts which convey the articles by the use of a spring drive for the conveyor belts. The spring drive is very inexpensive compared to motor drives. A problem with a spring drive is that it will apply the same constant drive force to the conveyor belt when it is loaded with five beverages or 60 ounces of liquid as when it is loaded with only a single twelve ounce beverage on the conveyor belt. This problem is overcome by speed control or dampening devices of a very low cost construction which which control the speed of conveyor belt travel to a predetermined constant speed irrespective of the number of articles on the conveyor belt. The present invention provides an accurate and consistent feed increment of, e.g., 0.75 inch to assure that an article will always be precisely positioned at the access position at the end of each conveyor travel and to assure that there actually has been a delivery of an article to the guest when the computer is signaled that a vending operation has been completed.

From a simplicity and low cost standpoint, the electrical components of the vending unit or magazine include only a solenoid operable to unlatch the pull handle and a pair of electrical switch contacts operable at the end of the conveyor travel. Such few and low cost electrical components add greatly to overall low cost of the vending unit. Both from a space and cost standpoint, the magazines are made with identical sidewalls which not only mount the conveyor and pull handles for the unit on one side, e.g., the right side but also for the left side of the sidewall. The use of plastic molded parts performing multiple functions, few and inexpensive electrical components, and a spring to power the vending unit, result in vending unit that may be made very inexpensively, e.g., under ten dollars per vending unit.

The present invention is not limited to uses only in hotels. For example, it could be used in hospitals to vend drugs or medicines and use with a credit card or the patients codes punched into the push buttons to cause a single vend of a medicine or drug in a relatively foolproof manner after a computer verification of authority to vend. The vend units may also be used in other vending machines of various kinds too numerous to discuss herein.

Figure 1:
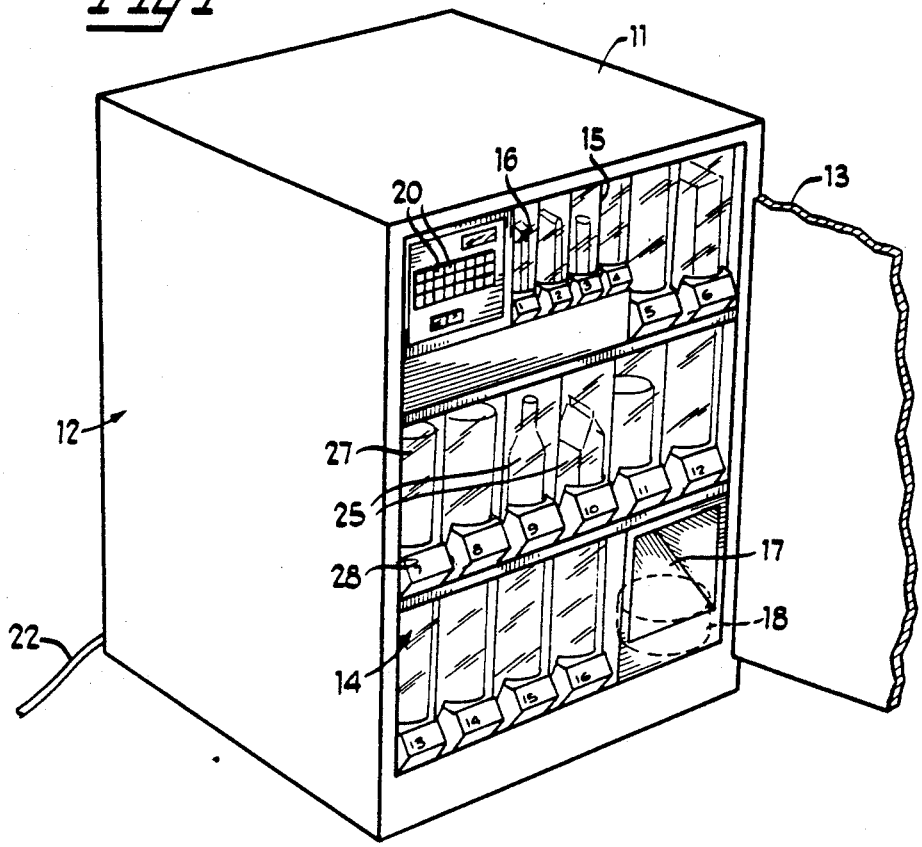
FIG. 1 is perspective view of a dispensing apparatus and cabinet constructed in accordance with the preferred embodiment invention.
Figure 15:
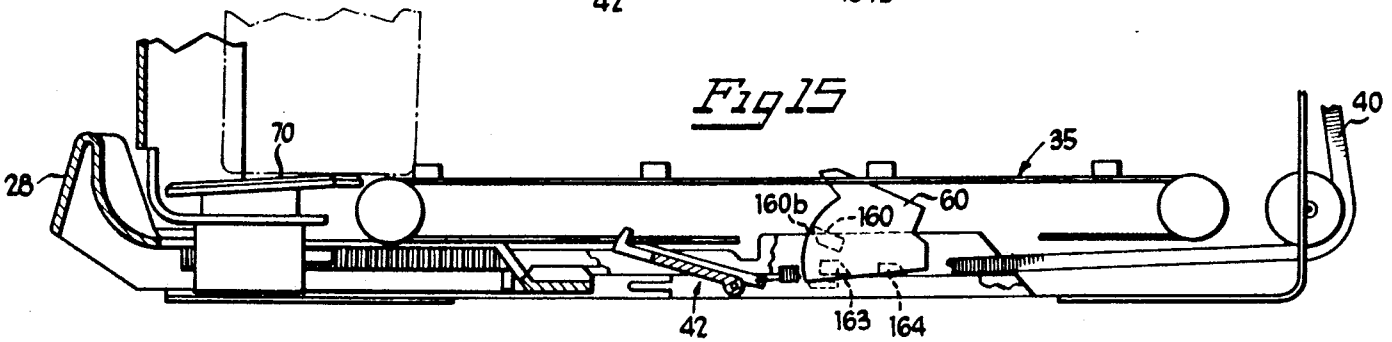
FIG. 15 is a view showing the pull handle fully returned and with the unit locked.

As shown in the drawings for purposes of illustration, the invention is embodied in a dispensing or vending apparatus in FIG. 1 which preferrably is in the form of a hotel dispensing or vending bar having a refrigerated cabinet or housing 12 which is a generally upright box shaped configuration, and has the general appearance of a piece of furniture. A hinged door 13 is provided to close access to the interior compartment 14, in which are located a plurality of vending units FIG. 15. The vending units may be of various sizes and shapes. For instance, vending units 1, 2, 3 and 4, which may be small vending units for dispensing candy, peanuts or other snack foods and may be disposed in a small upright tubes 16. Minature liquors may be in other of the units 1, 2, 3 and 4. The units 5 and 6 shown with a slightly different and larger shape for dispensing other snacks such as potato chips or pretzels of the like. A bottom drawer 17 is provided without a dispensor and it may be used to hold a bottle of champaign of the like. The other dispensing units 7–16 are substantially identical in size and are provided usually with soft drinks, milk, beer, wine and other beverages of various brands and costs.

The illustrated vending apparatus 11 usually small in size, e.g., approximately 3½ cubic feet which includes the total enclosed space which also includes a refrigeration unit or means 18 which is shown in dotted lines is located beneath the champaign receiving tray 17.

The preferred and illustrated vending unit 15 is controlled by the operation of a plurality of push-buttons 20 which are coded to coorespond to the respective vending units 1–16 and which upon operation in a matter of milaseconds sends down a signal to the central processor computer over a line or cable 22 which is connected to the TV cable and then to a central processing unit, as fully disclosed in the aforesaid pending patent application. The central processing unit may check to see whether or not the items being selected are allowed to be vended to children or the like. It is possible for the parents to notify the desk that no liquor is to be dispensed during certain times so that the children will not be able to have access to the liquor, but will have access to soft drinks or the like. Also, in some states there are so-called "Blue Laws" which forbid the sale of liquor on Sunday. The central processor may be used to lockout on Sunday the units which will dispense liquor in violation of the "Blue Laws". The computer may be programmed to provide the price for each dispensed unit and for adding the dispensed unit at this price to the guest's hotel bill. The push-button unit and this invention provides a cashless vending system.

Manifestly such a cashless vending system could be used with a credit card or the patient's identification numbers which could be punched into the dispensing apparatus 11 of FIG. 1 (and rather than dispensing food or beverage material), single dosages of medicine or drugs could be dispensed on the clearance of the authorization code by the central processor to which the dispensing would be connected by the cable 22. Other uses including a cash unit may be used in particularly with the particular dispensing units 15 which could be used in other combinations than that of the hotel bar illustrated herein.

Figure 2:
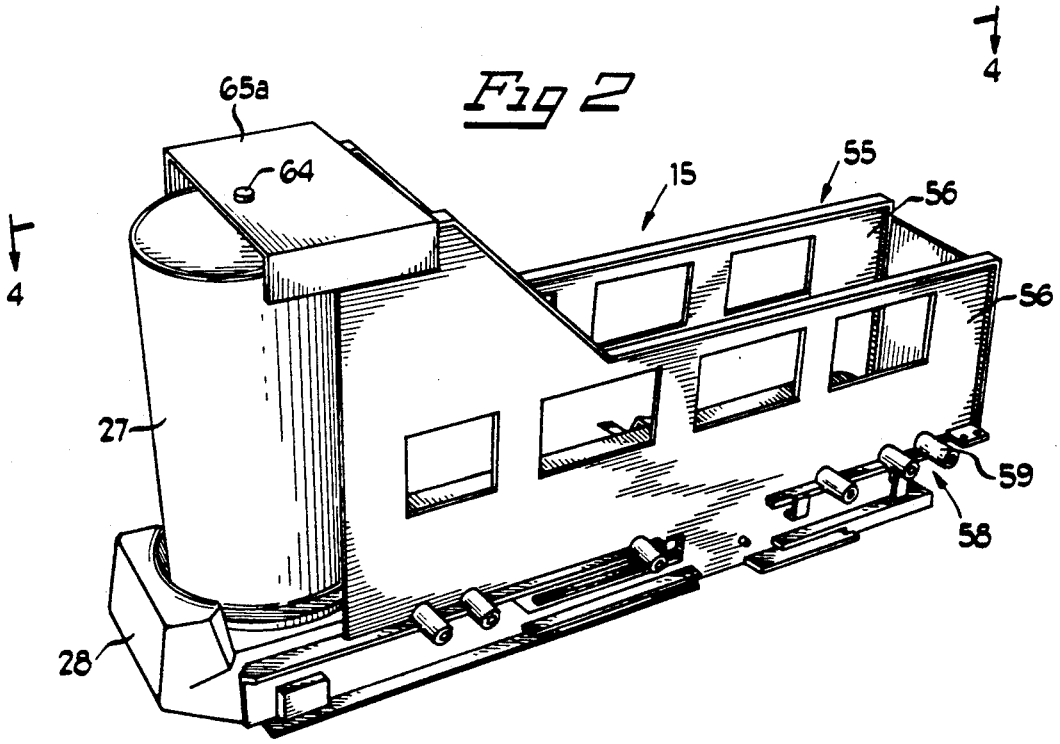
FIG. 2 is a perspective view of a dispensing unit or magazine used in the dispensing apparatus of FIG. 1.
Figure 13:
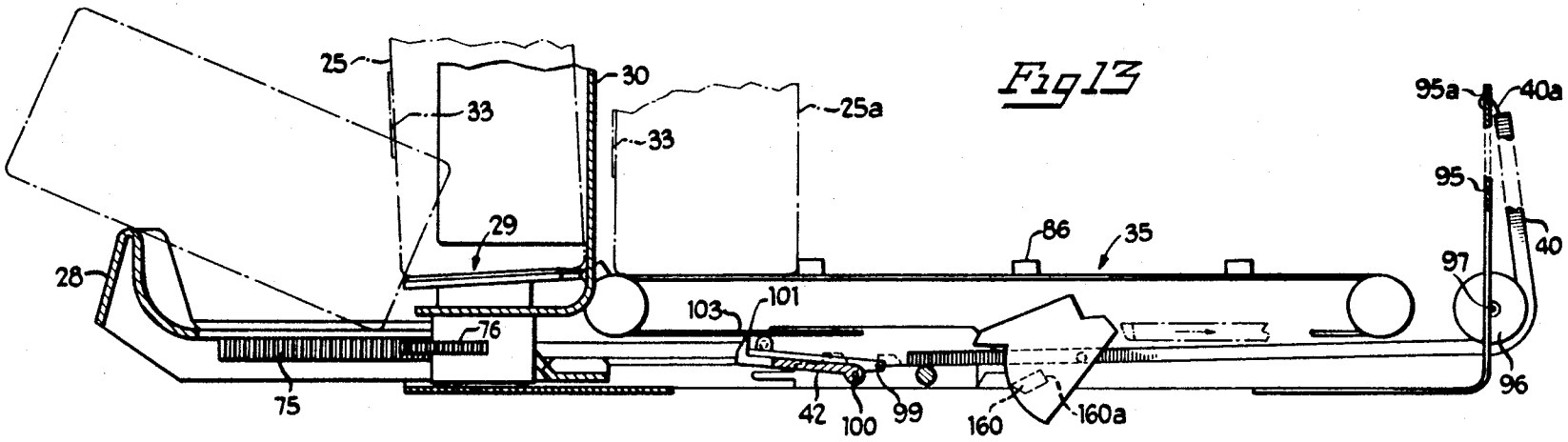
FIG. 13 is a sectional view showing the pull handle pulled open and a vending can being tipped and held by the pull handle.

As best seen in FIG. 1, an article 25 such as a can or bottle shown in dispensing units nos. 7 and 8 or a milk carton as shown in dispensing unit no. 10 maybe seen through a transparent access door 27. After punching the appropriate code and the enablement of a dispensing operation by a so-called signal from the central processor, a light may be shown or other signals given to allow the person to pull a pull-handle 28 to cause the access door 27 to open and to allow the person to have access to the article 27 at an access position 29 such as shown in FIG. 13. Each of the vending units or magazines 15, such as shown in FIG. 2, may be pulled outwardly upon release by the person doing the stocking of the unit with articles 27 being placed upright as shown in FIG. 13. In the illustrated embodiment of the invention there is a provision for holding five such large articles for dispensing in each unit with the dispensing travel being approximately ¾ of an inch which is about the width of the article. Manifestly, this distance of travel and the number of articles may vary. In units nos. 1, 2 and 3, there may be six articles with a shorter feeding increment. As shown in the drawings for purposes of illustration, the vending units or magazines are formed inexpensively mostly of plastic materials and include the pull-handle 28 which may be pulled to cause the rotation of the turnable access door 25 which pivots about a verticle axis to come to an open position shown in FIG. 13 in which the formerly front plastic wall 30 is now rearward of the article at the dispensing position 29 to block access to the second article 25*a* shown in FIG. 13. Each of the articles is disposed upright with its label 33 facing forwardly so it may be easily read by the guest and with the article being supported on and internal conveyor or conveyor means 35 which carries the articles forwardly one at a time into the vending position 29 behind the access door 27. The control means which is operable by the guest encodes the push-button selection controls at 20 and further includes an electrical means encoding a solenoid 37 shown in FIG. 3 which unlocks the pull-handle to allow it to be pulled outwardly.

In accordance with an important of the present invention, the conveyor means 35 is driven by a spring means 40, shown in FIG. 13, which is cocked or pulled to store energy as the pull handle 28 is pulled outwardly to rotate the turnable door 27 to allow access to the article 25. The pull-handle 28 does not directly drive the conveyor means 35 either during a pulled out movement or during a push inward movement. Instead the spring is cocked and it is locked with its stored energy until the handle is push backwardly to generally the position shown in FIG. 14. in which a drive means including a carrier 42 is connected to the conveyor and powered by the spring 40 to shift the conveyor through one predetermined increment of travel to move one article from its position immediately prior to the dispensing position 29 into that position behind the access door 27. Because there may be as many as 60 ounces on the conveyor or as little as 12 ounces or in other instances there may be light materials such as potato chips or other very light materials on the conveyor, it is desired that the speed of the conveyor be dampened or otherwise controlled by a speed control means 46 which is shown in detail in FIG. 11 and is connected to the conveyor means and includes in this instance a rotatable dampening member 47 rotatable in a viscous fluid 48. The viscousity of the liquid 48 may range from very light oil to very viscous almost tar-like materials which causes the member 47 to rotate very slowly under the spring force being applied to the conveyor.

Figure 3:
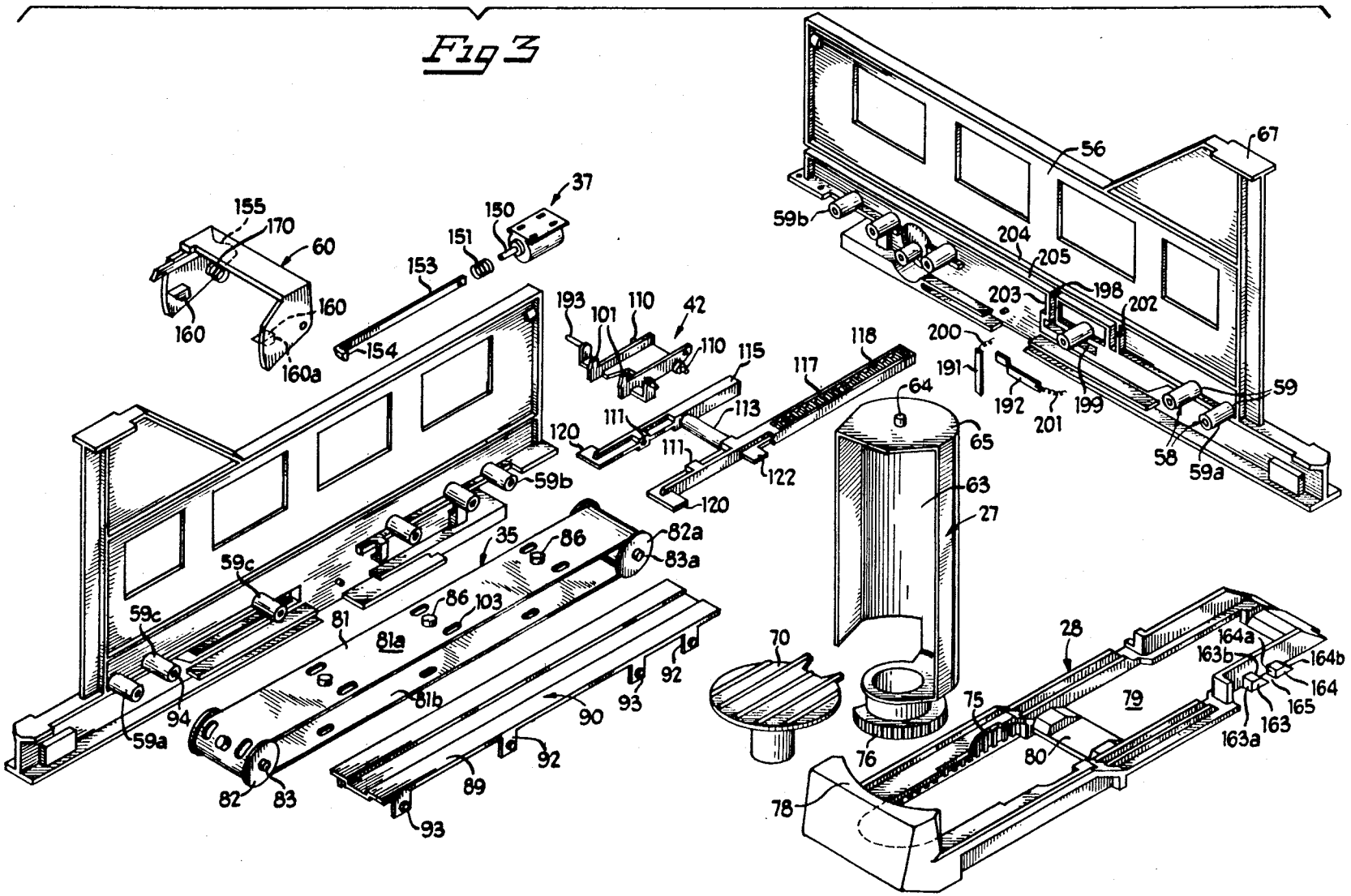
FIG. 3 is an exploded view showing the elements of the dispensing apparatus unit of FIG. 2.

Also in accordance with an important aspect of the invention, the dispensing unit 15 is made in an inexpensive manner by using a frame 55 shown in FIG. 2 made of identical sidwall units 56 as shown in FIG. 3 each of the sidewall units 56 has a plurality of mounting means 58 including bearing mounts 59 for mounting the conveyor thereon. The sidewalls 56 also support the half door 27 and mount the pull-handle 28 and the drive mechanism for the conveyor. The sidwalls also support the solenoid 37 and a releaseable block or lockh lever 60 which is mounted between the two walls 56. The particular walls are very universal in that they include not only the various mounts and guides for the unit facing inwardly between their respective sides as shown in FIG. 2 but they also have on their other side bearing mount means 58 including the bearing mounts 59 for the conveyor projecting outwardly. Thus, each of the sidewalls 56 is usable for an adjacent conveyor on its right and on its left so that there is no need to have separater walls or spaces between adjacent vending units.

As shown in the drawings for purposes of illustration, the access door 27 is a generally slightly more than half cylindrical body having a upright half cylindrical wall 63 with a upper pivot pin 64 in a top wall 65, the pivot pin forming an axis about which the door turns through 180 degrees. Best seen in FIG. 8, the door 27 has its pivot pin mounted for turning in an opening in an upper crossplate 65 which is fastened to top flanges 67 on the upper ends of the forward top most portions of the sidewalls 56. The crossplate thus joins the walls 56 together at their forward ends and holds them and is part of the frame unit. The lower end of the access door is journalled for rotation at a shoulder 69 in the article support pedestal 70 which in turn is secured by a fastener 71 to a lower mounting crossplate 72 which is also secured to lower flanges 73 of the respective crosswalls. The lower crossplate is also part of the frame.

To the manner of rotation of the access door 27 is by means of a rack 75 integrally molded on the pull-handle 28 as best seen in FIG. 3. Rack 75 is meshed with an integral gear segment 76 formed on the lower end of the access door 27. A pulling of the pull-hyandle 28 causes a horizontal linear movement of the rack 27 which then because of its meshed teeth with the gear 76 rotates the half door between its closed position shown in FIG. 1 in which it blocks access to the articles 25 and its open position shown in FIG. 13 in which an article 25 may be removed from the pedestal 70.

Figure 8:
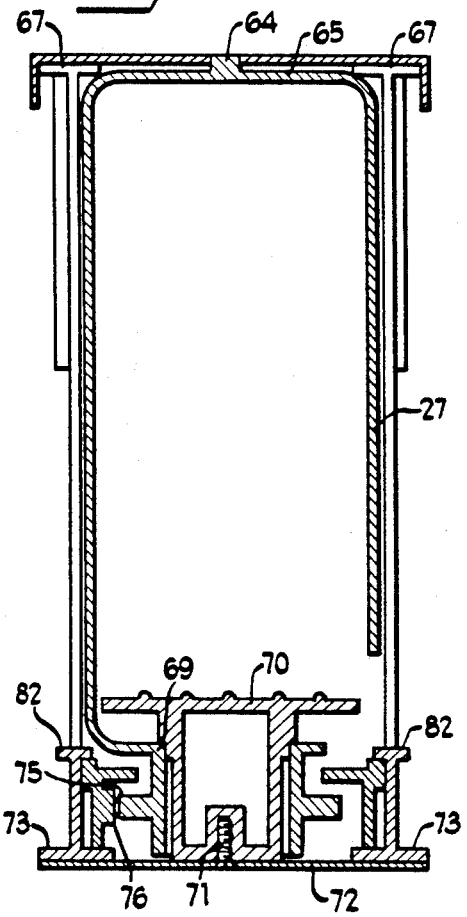
FIG. 8 is a sectional view taken substantially along the line of FIG. 4.
Figure 10:
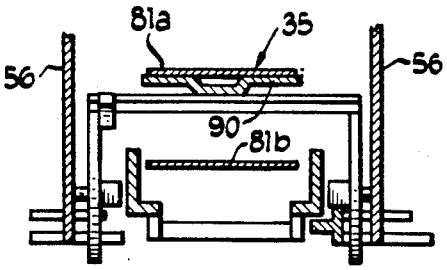
FIG. 10 is a sectional view taken substantially along the line of 10—10 of FIG. 4.

The pull-handle 28 performs a number of functions as will be described hereinafter in greater detail including not only the rotating of the access door 27 between its open and close positions but also the cocking of the elongated power spring 40 to provide energy and power for moving the carriage. The pull-handle 28 as thus seen in FIG. 3 has a forward or gripping handle end 78 and an elongated body having an internal opening 79 except for a crosspiece 80 generally at the middle of the pull-handle and just rearward of the rearward end of the rack 75. The pull-handle is slidably mounted for rectilinear movement between lower flanges 73 on the sideframes 56 as best seen in FIG. 8.

Turning now to the conveyor 35, it is preferably in the form of an endless belt 81 which is best seen in FIG. 3, extends endlessly between a forward roller 82 which is provided with pivot shafts 83 for mounting in the forward bearing amounts 59*a*. A rear rotatable roller 82*a* for the belt has pivot shafts 83*a* for mounting in the rear bearing mounts 59*b* on the sidewalls with the belt having an upper horizontal run 81*a* and a lower horizontal run 81*b*. The belt has a plurality of driving lugs 86 on the belt which project upwardly from the upper run of the belt to abut the rear side of the articles to push the same forwardly into the discharge and access position 29.

The belt is supported on its upper run by a horizontal conveyor support plate 89 as best seen in FIG. 3, which includes a top grooved plate portion 90 with four depending legs 92 on each side of the plate 89. Each of the legs has a outwardly projecting boss 93 for projecting into an aperture 94 in one of the bearing mounts 59*c*. Thus, the weight of the articles is supported by the conveyor supporting plate 90 as the articles are conveyed by the upper run of the belt.

Figure 4:
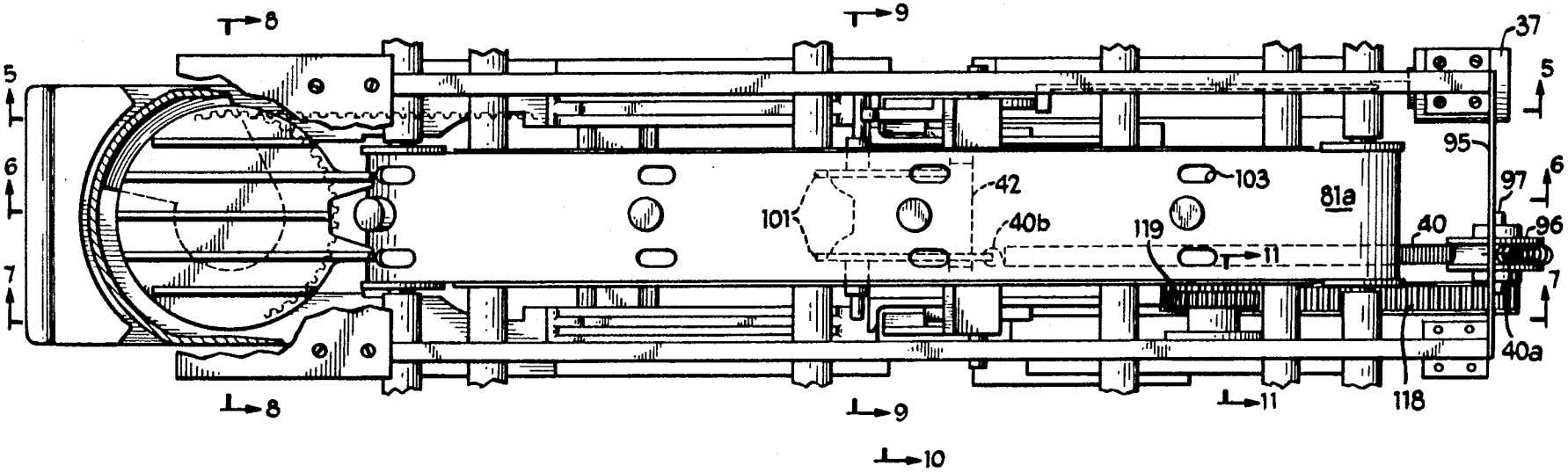
FIG. 4 is an enlarged plan view of a dispensing unit.

The force for driving the conveyor belt 35 and the driving mechanism for the conveyor belt includes the spring 40 which is a long contractile spring which has a rearward upper end 40*a* (FIG. 4) hooked to a rear plate 95. As best seen in FIG. 13, the upper end 40*a* of the spring is hooked into an aperture 95*a* in the rear plate with the contractile spring 40 extending downwardly to a rotatable roller 96 which is journalled to rotate about an axle 97 with the spring moving under the roller and beneath the conveyor belt to have its other end 40*b* (FIGS. 3 and 4) hooked at a hooking aperture 99 into the carrier 42. The illustrated spring is a fairly powerful spring and would cause the conveyor belt to travel too quickly but for the use of the dampening means 46. The spring 40 is connected to the carrier which pivots about an axis 100 (FIG. 13) to urge upwardly a pair of driving fingers 101 on the carrier 42, which when lifted to the positions shown in FIGS. 14 and 15, extend through apertures 103 in the belt. Going through the sequence of FIGS. 13, 14 and 15, the fingers 101 are first raised from the lowered position into the openings 103 in the belt will be inserted in the lower run of the belt and (as the push handle 28 is pushed rearwardly which is to the right in FIGS. 14 and 15), the carrier 42 travels rearwardly and pulls the lower run of the belt rearwardly while the top run 81*a* of the belt is moving in the opposite direction, i.e., forwardly. Each of the conveyor lugs 86 pushes its associated article 25 forwardly one full increment which is the length of the spacing between adjacent pairs of openings 103 in the conveyor belt. The use of the fingers and the openings in the conveyor belt is particular effective in providing a very exact movement and travel of the conveyor belt for each operation, so that the articles will always be dispensed and there will not be an operation in some time period when there has a too long or too short of a travel increment or when there is a travel increment which turn is out of synchronization with the pull-handle and with the door turn. The spacing between the openings 103 in the direction of travel of the belt is exactly equal to one increment of feed travel to move one article from the discharge position shown in FIG. 13 across, into and on top of the pedestal 70 at the access station 29.

As best seen in FIG. 3, the pair of fingers 101 on the carrier 42 forms a claw-like device which has a pair of rear pivot pins 110 at opposite ends which define a pivot axis for the carrier. The pivot pines 110 are snapped into openings 111 on a slide member 113, which as shown in FIG. 3, has a pair of spaced parallel bars 115 and 117. The bar 117 has a rack 118 which cooperates with a gear 119 of the damping device 46 of FIG. 11 to control the speed of conveyor travel. The slide member 113 is guided for rectilinear travel along the sidewalls by a pair of outwardly extending ears 120 at its forward portion and another ear 122 and its rearward portion as shown in FIG. 3.

Figure 11:
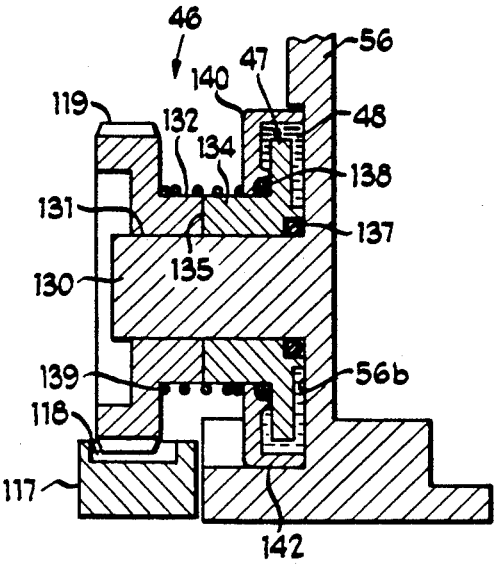
FIG. 11 is enlarged sectional view taken substantially along the line of 11—11 of FIG. 4.

The rack 117 on the carrier slide 113 for driving the dampening means 46 is shown in FIG. 11. A plastic gear 119 is mounted on a stub shaft 130 extending inwardly from the sidewall 56. The stub shaft 130 is integral with the sidewall 56 and the gear has an inner bore 131 for mounting on the stub shaft. A clutch will clutch the gear 119 to the rotatable member 47 to drive the rotatable member 47 in the viscous fluid 48 only when the upper run of the conveyor is travelling in the forward direction which is a slow direction of travel under the power of the spring 40. The illustrated clutch is a so-called "LGS" spring clutch 139 which has a plurality of coils wound on a first hub 132 on the gear 119 and a second plurality of coils wound about a hub 134 for the rotatable member 47 in the viscus fluid 48. The hubs 132 and 134 abut along a parting line 135 and are separate members each rotatable on the stub shaft 130. A suitable O-ring 137 cooperates With the rotatable member and the stub shaft to seal the viscus fluid at the lower outer end and another O-ring seal 138 seals between an outer cup 140 and the rotatable member to contain the fluid. An inexpensive manner of containing the fluid is provided by the cup 140 which is a small disc-shaped plastic piece which has an inner bore resting on the hub 134 of the rotatable member and has an outer encircling flange 142 abutting with a surface 56*b* on the sidewall to contain the viscus fluid 48.

Thus, it will be seen from the foregoing that the movement of the carrier slide and its rack 117 causes the gear 119 to turn which is, in turn, clutched by the clutch to the hub of the rotatable member 47 which has a generally annular rotatable flange within the viscous fluid which is sheared or otherwise displaced with friction therebetween during the turning of the rotatable member. By changing the viscosity of the material 48, the speed of rotation of the turntable member can be increased or decreased. In the reverse direction, when the rack is moving forwardly when the pull handle 28 is being pulled out, the spring clutch 139 unwinds and uncouples the two hubs so that the gear 119 rotates but the rotatable member 47 remains stationary in the viscous fluid.

Figure 5:
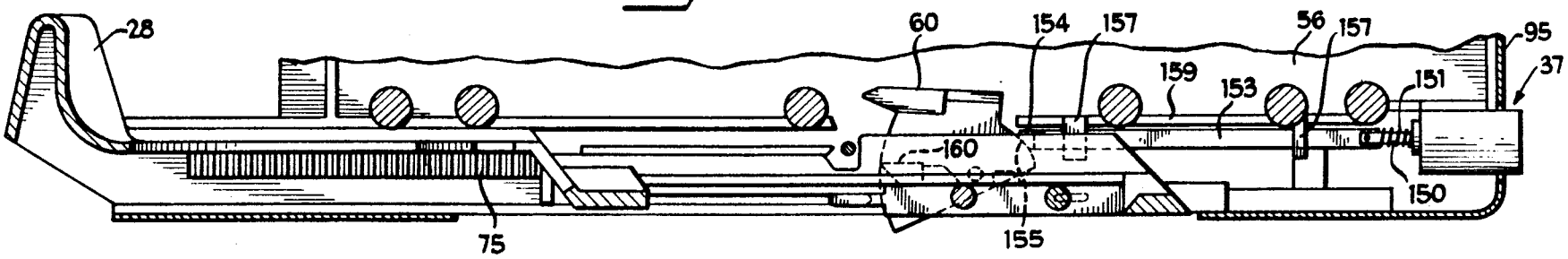
FIG. 5 is a sectional view taken substantially along the line 5—5 of FIG. 4.
Figure 6:
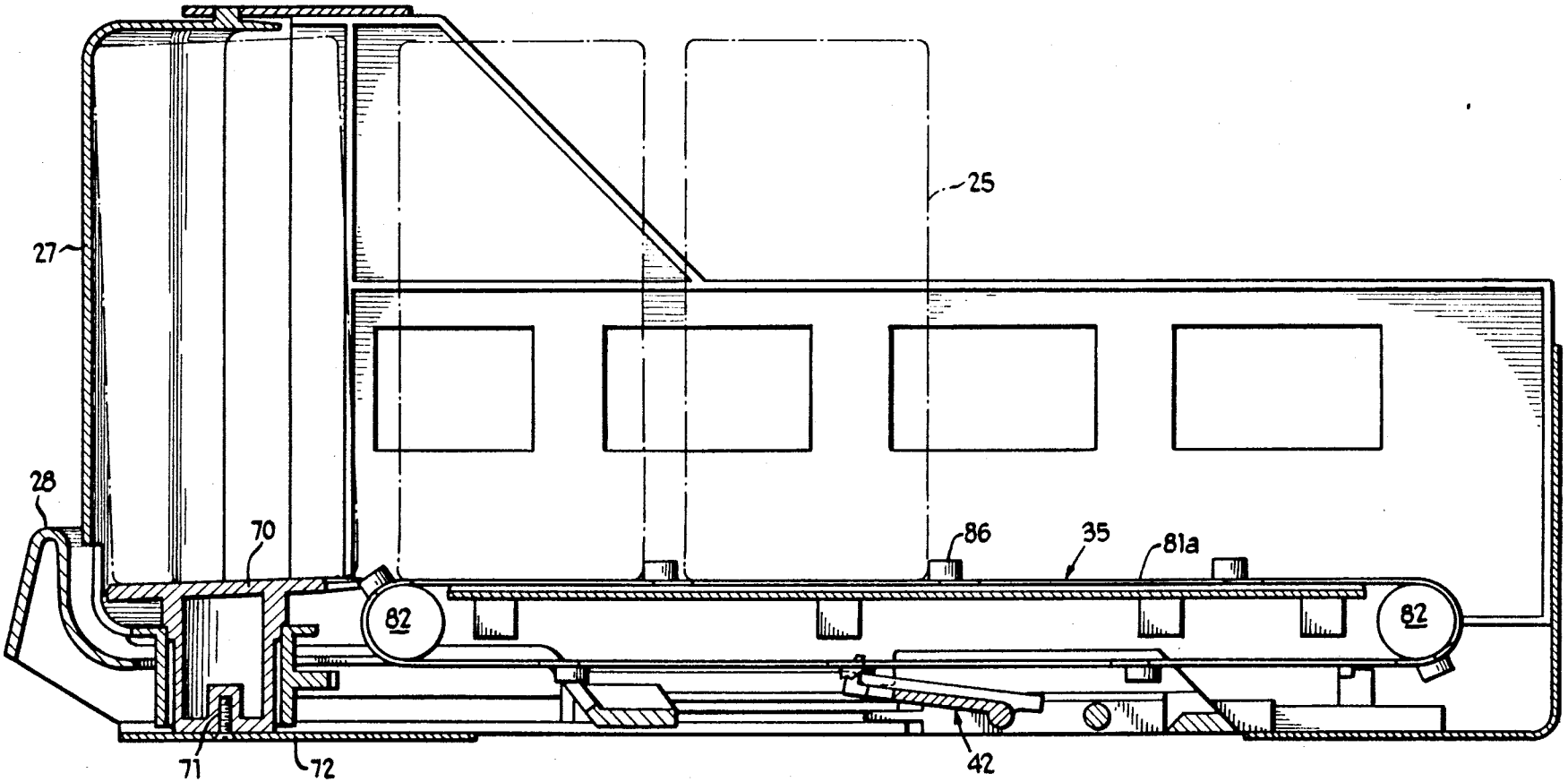
FIG. 6 is a sectional view taken substantially along the line 6—6 of FIG. 4.
Figure 7:
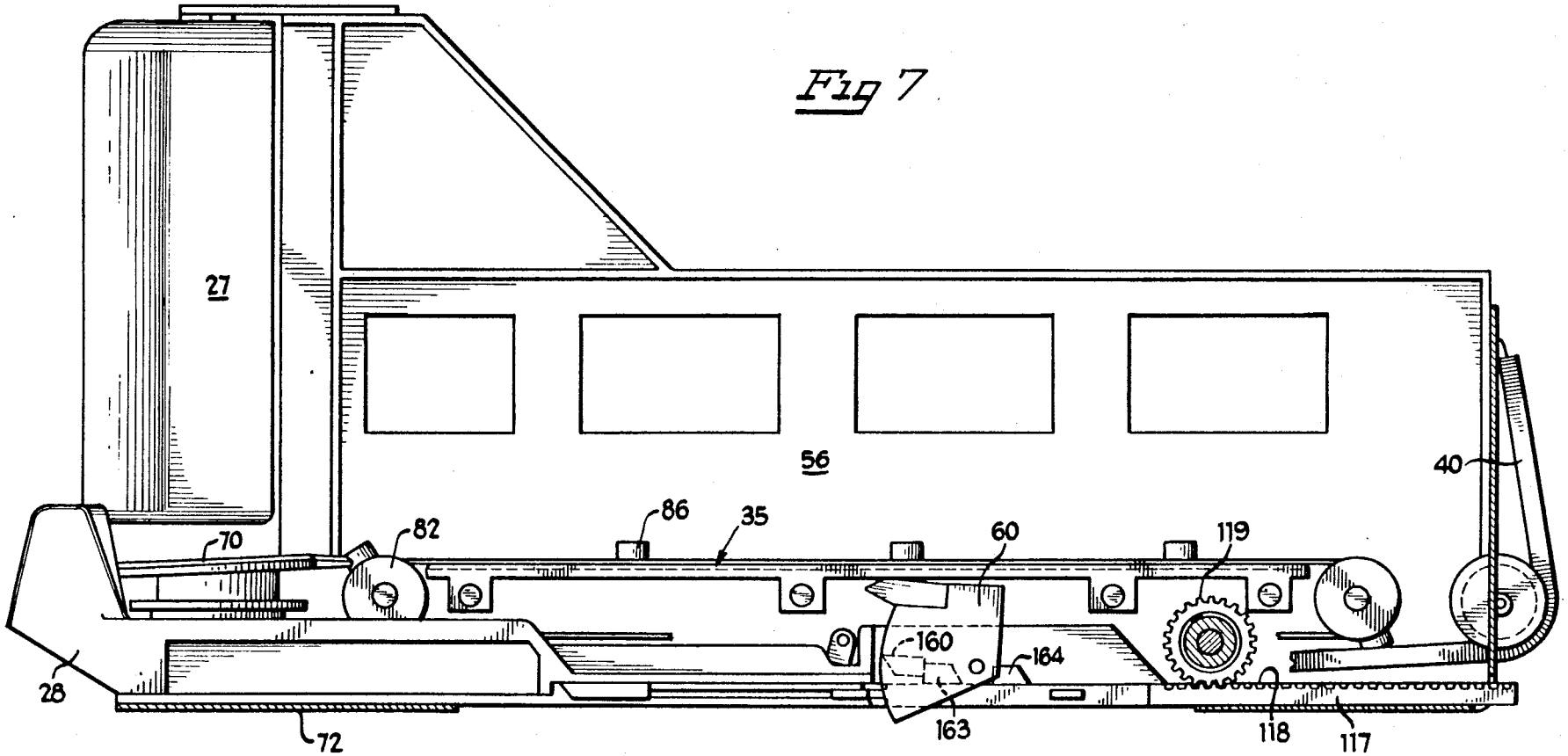
FIG. 7 is a sectional view taken substantially along the line of 7—7 of FIG. 4.

The pull-handle is normally locked in its locked position until its solenoid 37 (FIG. 3) is operated by the monitoring computer indicating that a vend is to be allowed. Upon energization, the solenoid pulls its plunger 150 inwardly against a return spring 151 to pull a lock link 153 rearwardly to move a locking or blocking finger 154 projecting at right angles to its position from overlying and blocking a shoulder 155 on the pivotal latch of locking lever 60. As best seen in FIG. 5, the locking line 153 is guided for its travel along the interior side of the sidewall 56. A pair of integral depending bars form slots with the sidewall 56 into which slots the lock link is inserted and guided for rectilinear travel. The lock links 154, as best seen in FIG. 5, has on its end a finger 154 of thickened crossectionaling over the part 155 to prevent turning of the lock lever 60 in the downward direction which would release the pull-handle for movement. Blocking the pull-handle 28 against a forward movement to dispense an article is achieved by the engagement of locking lugs 160 on the locking lever as best seen in FIG. 3 with locking lug 163 on the locking handle. The fully locked position is shown in FIG. 5 in which vertical walls 160*a* on the locking lugs 160 of the locking lever abut vertical walls 163*a* on the locking lugs on the pull-handle. As best seen in FIG. 3 there is a space 165 between the forward locking lug 163 and the rearward locking lug 164 on the pull-handle. When the pull-handle is a position between FIGS. 14 and 15, the locking lug 160 will be in a space 165 between locking lugs 163 and 164 to abut a similar vertical blocking surface 164*a* on the lug 164 on the pull-handle 28 so that the pull-handle can not be pulled fowardly.

Figure 14:
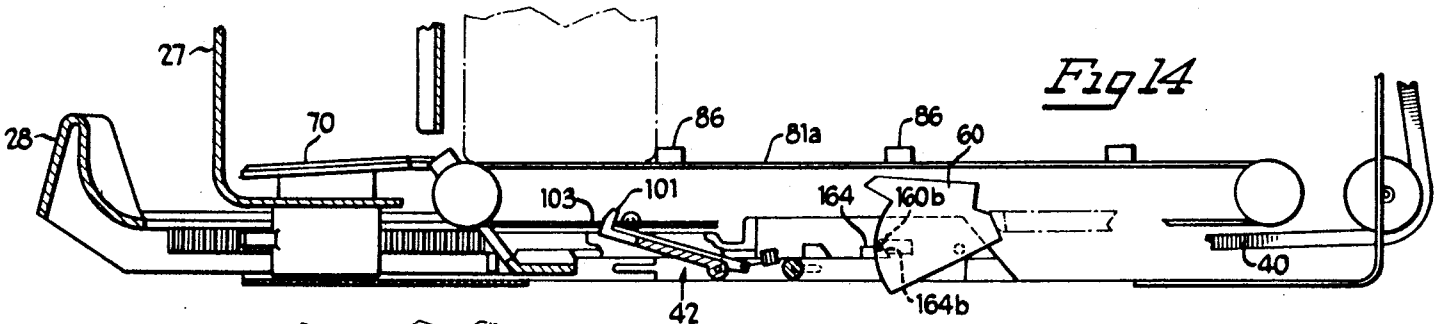
FIG. 14 is a view with a view of the pull handle partially returned.

The locking lever 60 is provided with its own torsion spring 170 (FIG. 3) which is connected to the wall 56 and to the locking lever to bias the locking lever to rotate the locking lug 60 downwardly to beneath the locking lugs 163 and 164 on the pull-handle 28 which then can be pulled forwardly as shown in FIG. 13. The pair of locking lugs 163 and 164 cooperate with the locking lug 160 and the locked lever 60 to prevent the false operation and a separate second vend of an item. More specifically, when the pull-handle lever 28 is pushed rearwardly as shown in FIG. 14 to just prior to the full return of the lock handle to the position shown in FIG. 15, the rear locking lug 164 brings its incline camming surface 164*b* as best seen in FIG. 14 against an incline surface 160*b* on the locking lug 160 of the lock lever 60 to pivot the same upwardly against the force of the torsion spring whereby the locking device will be allowed to move under and to pop immediately behind into the space 165 between the locking lugs 163 and 164. Thus, if someone tries at this instance to pull the pull-handle rearwardly, he will not be able to do so because the locking surface 160*a* on the locking lug 160 will hit the locking surface 164*a* on the rearward lug 164. A further push of the handle to the fully seated and closed position during which movement the incline 163*b* on the lug 163 is brought in to engagement with inclined surface 160*b* on the lug 160 to pivot the locking lever 60 upwardly so that the locking lugg 163 may travel to bring blocking surface 163*a* on the locking lug into blocking engagement with the blocking vertical surface 160*a* on the lugs 160. Thus, the locking lever will be fully returned to its full locking position at the end of this inward movement of the pull-handle 28. The lock lever is thus positioned for again being sequenced by operation of the solenoid 37 in the manner above described.

Figure 12:
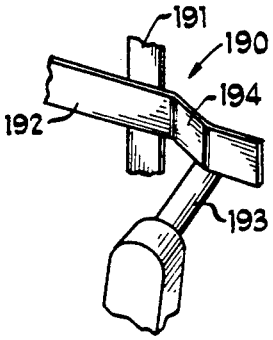
FIG. 12 is an enlarged view of an electrical switch contact and and actuator therefor.
Figure 9:
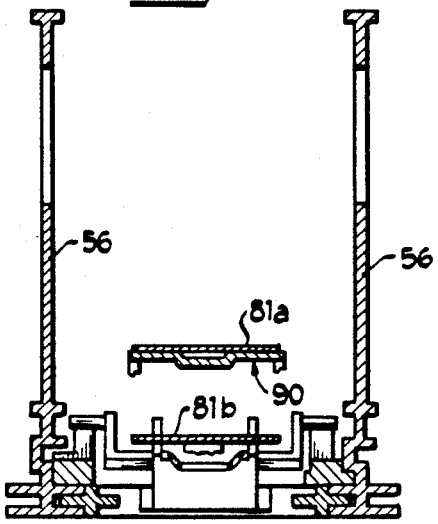
FIG. 9 is a sectional view taken substantially along the line of 9—9 of FIG. 4.

At the end of a dispensing operation, an inexpensive electrical switch means 190, as best seen in FIG. 12 is actuated. The electrical switch means is formed very inexpensively with a first vertical small strip of contact metal 191 mounted in the sidewall 56 and a second horizontally extending metal contact strip 192 is also mounted in the wall and is spaced and biased therefrom so as to be out of contact therewith until a actuator pin 193 on the carrier 42 has completed its movement to cam against incline cam surface 194 (FIG. 12) to cause the two metal contact strips 191 and 192 to engage and to complete an electrical circuit showing that a dispensing operation has been made. As best seen in FIG. 3 the metal strips are mounted in the sidewalls 56 with vertical strip 191 being located at 198 in FIG. 3 on the right-hand sidewall 56 and with the horizontal strip 192 at the location 199. The strips 191 and 192 are inserted into grooves and openings in the sidewall 56 and are held by the sidewall without having to purchase a separate switch. Electrical lead lines 200 and 201 shown in FIG. 3 are run into channels 202 and 203 and across horizontal channels 204 and 205 to the rearward end of the sidewalls from the switch contract strips 191 and 192.

What is claimed is:

1. In a vending apparatus for vending a plurality of articles from a plurality of vending units, the combination comprising:

a housing having an access door:

a plurality of vending units in the housing each for vending an article;

a manually actuatable handle associated with each vend unit to be actuated by the vendee to cause a vending of an article;

an upright, substantially semi-cylindrical turnable access door in said vending units rotatable by the handle to turn from a closed position denying access to the article to an open vending position allowing access to the article being dispensed from the upright, substantially semi-cylindrical, turnable access door;

a conveyor means in the vending units for holding a plurality of articles and for conveying each of the articles on the conveyor to the vending position behind the upright, substantially cylindrical, turnable access door; and electrical control means for disabling the access door to vending and operable by the vendee to enable the vending unit to allow the manually operated handle to be manually actuated to turn the upright, substantially cylindrical, turnable access door to allow removal of the article.

2. A vending apparatus in accordance with claim 1 including a spring for driving the conveyor to move forwardly to deliver a new article into the vending position, said spring being energized by the pulling of the handle.

3. A vending apparatus in accordance with claim 1 in which the control means includes an electrical actuator operable by an electrical signal indicating an authorized vend to allow the pull handle to be actuated to vend an article.

4. A vending apparatus in accordance with claim 1 including anti-tipping means associated with the conveyor for holding the articles upright against tipping when the vending apparatus is vibrated or shook.

5. In a vending apparatus for vending a plurality of articles from a plurality of vending units, the combination comprising:

a housing having an access door:

a plurality of vending units in the housing each for vending an article;

a handle associated with each vend unit to be actuated by the vendee to cause a vending of an article;

a turnable access door in said vending units actuated by the handle to turn from a closed position denying access to the article to an open vending position allowing access to the article;

a conveyor means in the vending units for holding a plurality of articles and for conveying each of the articles on the conveyor to the vending position behind the turnable door;

control means operable by the vendee to enable the vending unit to allow the handle to be actuated to turn the turnable door to allow removal of the article;

a spring for driving the conveyor to move forwardly to deliver a new article into the vending position, said spring being energized by the pulling of the handle; and a speed control means controlling the speed of conveyor travel to provide a substantially constant travel speed irrespective of the number of articles on the conveyor.

6. A vending apparatus in accordance with claim 5 in which the handle is pulled outwardly to energize the spring, a locking means locks the conveyor against forward travel by the energized spring means, the handle being pushed inwardly towards its closed position operating the locking means to release the spring to move the conveyor independently of the force being applied to the handle.

7. In a vending apparatus for vending a plurality of articles from a plurality of vending units, the combination comprising:

a housing having an access door:

a plurality of vending units in the housing each for vending an article;

a handle associated with each vend unit to be actuated by the vendee to cause a vending of an article;

a turnable access door in said vending units actuated by the handle to turn from a closed position denying access to the article to an open vending position allowing access to the article;

a conveyor means in the vending units for holding a plurality of articles and for conveying each of the articles on the conveyor to the vending position behind the turnable door; and control means operable by the vendee to enable the vending unit to allow the handle to be actuated to turn the turnable door to allow removal of the article;

a rack is molded on the pull handle and a gear is molded on the door, pulling of the handle moving the rack to turn the gear to turn the door to its open position, pushing of the handle moving the rack to turn the gear and the door to its closed position.

8. A vending apparatus in accordance with claim 7 including an electrical switch operable upon a push and return of the handle to signal that a vending operation has been completed.

9. A vending unit for vending articles comprising:

a frame having side walls;

a conveyor belt mounted on the frame for endless movement and having an upper run for supporting a plurality of articles to be vended;

a rotatable half door at a discharge end of the conveyor belt rotatable from a first closed position denying access to an article at a vending position to a second position allowing access to the article at the vending position and denying access to other articles on the conveyor belt;

a manually operable handle moveable in a first direction to rotate the half door to the second position to allow vending of the article from the vending position, the handle being moveable in a return direction to cause the conveyor belt to move forwardly and to discharge an article therefrom into the vending position; and a spring provides the power to drive the conveyor belt, said spring being cocked to store energy by movement of the handle.

10. A vending unit in accordance with claim 9 in which a solevoid operated locking means locks the handle against movement until the solevoid locking means is electrically operated to an unlocking position at which the handle is free for movement.

11. A vending unit in accordance with claim 10 in which an electrical switch is provided on the frame to signal a vending operation has been completed.

12. A vending unit in accordance with claim 9 in which a dampening and speed control means is provided to control the speed of travel of the conveyor belt by the spring to provide a substantially uniform travel speed for the conveyor belt irrespective of the number of articles and the weight of the articles on the conveyor belt.

13. A vending unit in accordance with claim 12 in which the dampening means comprises a viscous material in a cup and a rotatable member rotatable in the cup against the resistance of the viscous material, the rotatable member being connected to the conveyor belt to control the speed thereof.

14. A vending unit in accordance with claim 13 in which a clutch means clutch the rotatable member to the conveyor belt to dampened the movement thereof in the forward article feeding direction.

15. A vending unit for vending articles comprising:

a frame having side walls;

a conveyor belt mounted on the frame for endless movement and having an upper run for supporting a plurality of articles to be vended;

a rotatable half door at a discharge end of the conveyor belt rotatable from a first closed position denying access to an article at a vending position to a second position allowing access to the article at the vending position and denying access to other articles on the conveyor belt;

a manually operable handle movable in a first direction to rotate the half door to the second position to allow vending of the article from the vending position, the handle being movable in a return direction to cause the conveyor belt to move forwardly and to discharge an article therefrom into the vending position;

the conveyor belt being provided with openings therein spaced to correspond to predetermined vending increments of travel, and an actuator for moving the conveyor belt being inserted into openings in the belt and being moved to force the belt to travel through the increment of travel.

16. A vending unit in accordance with claim 15 in which the actuator comprises a carrier moveable rectilinearly beneath a lower run of the conveyor belt, a pair of fingers on the carrier moveable upwardly into a pair of aligned openings into the belt, a spring means drives the carrier in the reverse direction to pull the lower run rearwardly while the upper run of the conveyor belt travels forwardly, the fingers on the carrier being dropped downwardly and the carrier being returned upon a subsequent movement of the handle.

17. In a vending apparatus for vending a plurality of articles from a plurality of vending units, the combination comprising:

a housing having an access door:

a plurality of vending units in the housing each for vending an article;

a handle associated with each vend unit to be actuated by the vendee to cause a vending of an article;

a turnable access door in said vending units actuated by the handle to turn from a closed position denying access to the article to an open vending position allowing access to the article;

a conveyor means in the vending units for holding a plurality of articles and for conveying each of the articles on the conveyor to the vending position behind the turnable door;

control means operable by the vendee to enable the vending unit to allow the handle to be actuated to turn the turnable door to allow removal of the article;

anti-tipping means associated with the conveyor for holding the articles upright against tipping when the vending apparatus is vibrated or shook; and anti-tipping means comprising flexible members pointed in the direction of conveyor travel and flexed apart by the article passing these members, the members being stiff and relatively inflexible when an article tries to fall backward and to displace the flexible members in its backward falling movement.

18. A vending unit for vending articles comprising:

a frame having side walls;

a conveyor belt mounted on the frame for endless movement and having an upper run for supporting a plurality of articles to be vended;

a rotatable half door at a discharge end of the conveyor belt rotatable from a first closed position denying access to an article at a vending position to a second position allowing access to the article at the vending position and denying access to other articles on the conveyor belt;

a manually operable handle movable in a first direction to rotate the half door to the second position to allow vending of the article from the vending position, the handle being movable in a return direction to cause the conveyor belt to move forwardly and to discharge an article therefrom into the vending position; and the frame comprising a pair of identical sidewalls spaced from each other, bearing mounts on the respective sidewalls projecting inwardly toward each other to support the conveyor and projecting outwardly on outer sides thereof to support one side of a conveyor belt of another vending unit.

* * * * *

UNITED STATES PATENT AND TRADEMARK OFFICE

CERTIFICATE OF CORRECTION

PATENT NO. : 5,150,817

DATED : September 29, 1992

INVENTOR(S) : Troy W. Livingston

It is certified that error appears in the above-identified patent and that said Letters Patent is hereby corrected as shown below:

Column 1, line 20, change "go the the" to --go to the--.

Column 2, lines 10-11, change "eight five" to --eighty-five--.

Column 2, line 15, change "rooms" to --rooms'--.

Column 2, line 21, after "caught" delete "to".

Column 2, line 23, change "beverages" to --beverage--.

Column 2, line 32, after "bottles" change "or" to --are--.

Column 2, line 48, delete the second occurrence of "which".

Column 3, line 3, change "unit" to --units--.

Column 3, line 7, change "use" to --used--.

Column 3, line 8, change "patients" to --patients'--.

Column 3, line 16, after "is" insert --a--.

Column 3, line 36, after "is" insert --an--.

Column 3, line 39, change "and", second occurrence, to --an--.

Column 3, line 55, delete "FIG.".

Column 3, line 57, delete "which".

UNITED STATES PATENT AND TRADEMARK OFFICE

CERTIFICATE OF CORRECTION

PATENT NO. : 5,150,817

DATED : September 29, 1992

INVENTOR(S) : Troy W. Livingston

It is certified that error appears in the above-identified patent and that said Letters Patent is hereby corrected as shown below:

Column 3, line 59, delete "a".

Column 3, line 60, change "minature" to --miniature--.

Column 3, line 61, change "and" to --or--.

Column 3, line 61, after "6" insert --are--.

Column 3, line 63, change "of" to --or--.

Column 3, line 64, change "dispensor" to --dispenser--.

Column 3, line 65, change "of", second occurrence, to --or--.

Column 4, line 27, change "and" to --of--.

Column 4, line 37, change "particularly" to --particular--.

Column 4, line 67, change "verticle" to --vertical--.

Column 5, line 5, change "and", second occurrence, to --an--.

Column 5, line 13, after "important" insert --aspect--.

Column 5, line 22, change "push" to --pushed--.

Column 5, line 23, after "FIG. 14" delete the period.

Column 5, line 51, change "lockh" to --lock--.

Column 5, line 64, change "a" to --an--.

UNITED STATES PATENT AND TRADEMARK OFFICE

CERTIFICATE OF CORRECTION

PATENT NO. : 5,150,817

DATED : September 29, 1992

INVENTOR(S) : Troy W. Livingston

It is certified that error appears in the above-identified patent and that said Letters Patent is hereby corrected as shown below:

Column 5, line 65, change "a", first occurrence, to --an--.

Column 5, line 67, change "Best" to --As best--.

Column 6, line 11, change "to the" to --The--.

Column 6, line 25, change "close" to --closed--.

Column 6, line 39, change "amounts" to --mounts--.

Column 6, line 52, change "a" to --an--.

Column 7, line 9, after "belt" insert --and--.

Column 7, line 11, change "push handle" to --pull-handle--.

Column 7, line 20, change "particular" to --particularly--.

Column 7, line 24, change "has" to --is--.

Column 7, line 35, change "pines" to --pins--.

Column 7, line 43, change "and", second occurrence, to --at--.

Column 7, line 59, change "viscus" to --viscous--.

Column 7, line 62, change "With" to --with--.

Column 7, line 63, change "viscus" to --viscous--.

Column 8, line 3, change "viscus" to --viscous--.

UNITED STATES PATENT AND TRADEMARK OFFICE

CERTIFICATE OF CORRECTION

PATENT NO. : 5,150,817

DATED : September 29, 1992

INVENTOR(S) : Troy W. Livingston

It is certified that error appears in the above-identified patent and that said Letters Patent is hereby corrected as shown below:

Column 8, line 12, change "turntable" to --turnable--.

Column 8, line 28, change "line" to --link--.

Column 8, line 32, change "links" to --link--.

Column 8, line 32, change "154" to --153--.

Column 8, line 33, change "crossectionaling" to --cross-section--.

Column 8, line 46, after "is" insert --in--.

Column 8, line 55, change "60" to --160--.

Column 8, line 59, change "locked" to --locking--.

Column 8, line 61, delete "lever".

Column 8, line 63, change "lock handle" to --pull-handle--.

Column 8, line 66, change "lock" to --locking--.

Column 9, line 9, change "in to" to --into--.

Column 9, line 11, change "lugg" to --lug--.

Column 9, line 27, change "a" to --an--.

Column 9, line 42, change "contract" to --contact--.

UNITED STATES PATENT AND TRADEMARK OFFICE

CERTIFICATE OF CORRECTION

PATENT NO. : 5,150,817

DATED : September 29, 1992

INVENTOR(S) : Troy W. Livingston

It is certified that error appears in the above-identified patent and that said Letters Patent is hereby corrected as shown below:

IN THE CLAIMS:

Column 11, line 36, change "solevoid" to --solenoid--.

Column 11, line 37, change "solevoid" to --solenoid--.

Column 11, line 57, change "clutch", second occurrence, to --clutches--.

Column 11, line 58, change "dampened" to --dampen--.

Signed and Sealed this

Eighteenth Day of January, 1994

*Attest:*

Bruce Lehman

BRUCE LEHMAN

*Attesting Officer*

*Commissioner of Patents and Trademarks*